US009190814B1

(12) United States Patent
Kamada

(10) Patent No.: US 9,190,814 B1
(45) Date of Patent: Nov. 17, 2015

(54) MANUFACTURING METHOD OF SPARK PLUG

(71) Applicant: NGK SPARK PLUG CO., LTD., Nagoya-shi, Aichi (JP)

(72) Inventor: Itaru Kamada, Aichi-ken (JP)

(73) Assignee: NGK Spark Plug Co., Ltd., Nagoya-Shi, Aichi (JP)

( * ) Notice: Subject to any disclaimer, the term of this patent is extended or adjusted under 35 U.S.C. 154(b) by 0 days.

(21) Appl. No.: 14/718,424

(22) Filed: May 21, 2015

(30) Foreign Application Priority Data

May 21, 2014 (JP) ..... 2014-104897

(51) Int. Cl.
*H01J 9/00* (2006.01)
*H01T 21/02* (2006.01)

(52) U.S. Cl.
CPC ..... *H01T 21/02* (2013.01)

(58) Field of Classification Search
CPC ..... H01T 21/02
USPC ..... 445/7
See application file for complete search history.

(56) References Cited

U.S. PATENT DOCUMENTS

2013/0065473 A1* 3/2013 Kanemaru ..... H01T 21/02 445/7
2014/0225496 A1* 8/2014 Kawai ..... H01T 21/02 313/141

FOREIGN PATENT DOCUMENTS

JP 2003-223968 A 8/2003 ..... H01T 13/02
JP 2011-175985 A 9/2011 ..... H01T 13/20

* cited by examiner

*Primary Examiner* — Joseph L Williams
(74) *Attorney, Agent, or Firm* — Kusner & Jaffe

(57) ABSTRACT

A manufacturing method for manufacturing a spark plug including a rod-shaped center electrode extending in an axial direction, an insulator having a tubular shape having an axial hole and holding the center electrode in the axial hole, a metal shell having a tubular shape having an end surface and an inner peripheral surface, a gap being formed between a leading end side of the insulator and the inner peripheral surface, and a ground electrode welded to the end surface, the manufacturing method including welding the ground electrode to the end surface, and removing welding sag, which is formed inside the metal shell by the welding, by causing a tip end portion of a linear member to come into contact with the welding sag while rotating a tool in which a base end portion of the linear member is fixed.

10 Claims, 10 Drawing Sheets

MANUFACTURING METHOD OF SPARK PLUG

RELATED APPLICATIONS

This application claims priority from Japanese Patent Application No. 2014-104897 filed on May 21, 2014, the entire contents of which are incorporated herein by reference.

FIELD OF THE INVENTION

Aspects of the present invention relate to a manufacturing method of a spark plug.

BACKGROUND OF THE INVENTION

In general, a spark plug includes a center electrode, an insulator, a metal shell, and a ground electrode. The metal shell of the spark plug has a tubular shape having an end surface and an inner peripheral surface. The end surface of the metal shell is connected to the ground electrode. A gap for preventing spark leak (lateral spark) is formed between the inner peripheral surface of the metal shell and the insulator holding the center electrode. Spark leak is a phenomenon in which spark discharge is generated at a portion different from a spark gap between the center electrode and the ground electrode.

JP-A-2003-223968 and JP-A-2011-175985 disclose techniques in which the end surface and the inner peripheral surface are formed to the metal shell and then the ground electrode is welded to the end surface of the metal shell. When the ground electrode is welded to the end surface of the metal shell, welding sag may protrude to the inside of the metal shell and such welding sag becomes a cause of the spark leak. Furthermore, JP-A-2003-223968 discloses a technique in which the ground electrode is welded to the end surface of the metal shell and then the welding sag protruding to the inside of the metal shell is removed by a shearing process or a cutting process.

In the techniques disclosed in JP-A-2003-223968 and JP-A-2011-175985, there is a problem that it is difficult to sufficiently further reduce a protrusion amount of the welding sag on the inside of the metal shell from the viewpoint of ensuring a bonding strength of bonding the ground electrode to the metal shell and preventing damage with respect to the inner peripheral surface of the metal shell. Particularly, when a size of the spark plug is reduced, since an influence of the welding sag to the spark leak becomes noticeable, it is necessary to further reduce the protrusion amount of the welding sag.

SUMMARY OF THE INVENTION

Aspects of the invention is provided to solve the above problem and can be realized as follows:

According to an aspect of the invention, there is provided a manufacturing method of a spark plug for manufacturing the spark plug including a rod-shaped center electrode extending in an axial direction, an insulator having a tubular shape having an axial hole and holding the center electrode in the axial hole, a metal shell having a tubular shape having an end surface and an inner peripheral surface, a gap being formed between a leading end side of the insulator and the inner peripheral surface, and a ground electrode welded to the end surface, the manufacturing method including: welding the ground electrode to the end surface; and removing welding sag, which is formed inside the metal shell by the welding, by causing a tip end portion of a linear member to come into contact with the welding sag while rotating a tool in which a base end portion of the linear member is fixed.

Accordingly, since the welding sag is grinded by the tip end portion of the linear member bent to the outside by a centrifugal force due to the rotation, it is possible to effectively remove the welding sag protruding to the inside of the metal shell.

The invention can be realized by various forms other than the spark plug and the manufacturing method of the spark plug. For example, the invention can be realized in a form of a metal shell to which a ground electrode is welded, an internal combustion engine including a spark plug, and a manufacturing apparatus of a spark plug.

DETAILED DESCRIPTION OF THE PREFERRED EMBODIMENTS

A. Embodiment

A1. Configuration of Spark Plug

Figure 1:
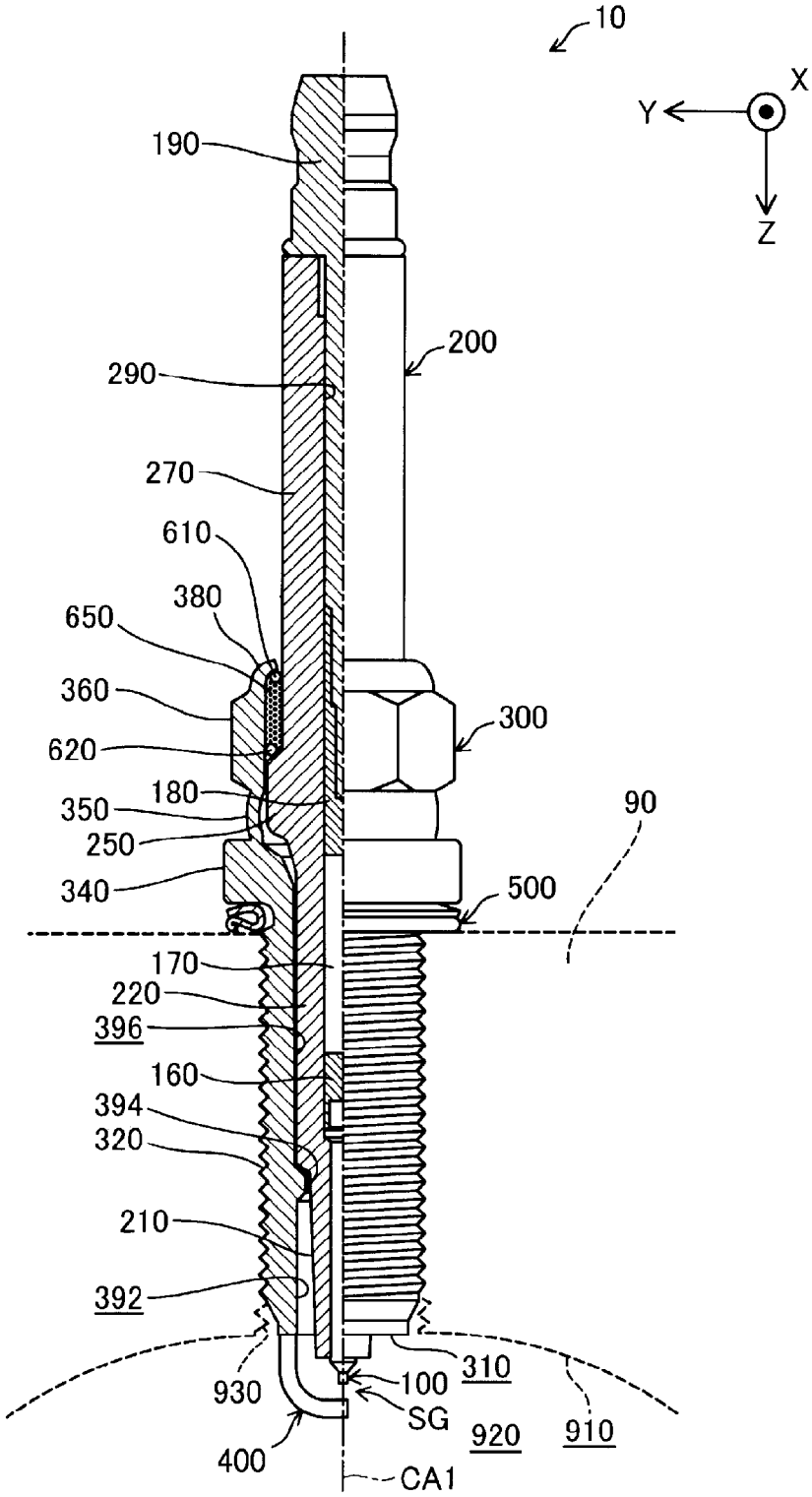
FIG. 1 is an explanatory view illustrating a cross section of a portion of a spark plug.

FIG. 1 is an explanatory view illustrating a cross section of a portion of a spark plug 10. FIG. 1 illustrates an external shape of a spark plug 10 on a right side of the sheet and a cross section shape of the spark plug 10 on a left side of the sheet. An axial line CA1, which is an axis of the spark plug 10, serves as a boundary between the left side of the sheet and the right side of the sheet. In the description of the embodiment, a lower side of the sheet of FIG. 1 is referred to as a "leading end side" and an upper side of the sheet of FIG. 1 is referred to as a "rear end side" of the spark plug 10.

The spark plug 10 includes a center electrode 100, an insulator 200, the metal shell 300, and a ground electrode 400. The axial line CA1 of the spark plug 10 is also an axis of each of the center electrode 100, the insulator 200, and the metal shell 300.

The spark plug 10 has a gap SG formed between the center electrode 100 and the ground electrode 400 at the leading end side thereof. The gap SG of the spark plug 10 is also referred to as a spark gap. The spark plug 10 is configured to be mountable to an internal combustion engine 90 in a state where the leading end side, to which the gap SG is formed, protrudes from an inner wall 910 of a combustion chamber 920. If a high voltage of 20000 volts to 30000 volts is applied to the center electrode 100 in a state where the spark plug 10 is mounted on the internal combustion engine 90, spark discharge is generated at the gap SG. The spark discharge generated at the gap SG realizes ignition to mixed air in the combustion chamber 920.

FIG. 1 illustrates XYZ axes which are perpendicular to each other. The XYZ axes of FIG. 1 correspond to XYZ axes in other views described hereinafter. An X axis among the XYZ axes of FIG. 1 is an axis perpendicular to a Y axis and a Z axis. Among an X axis direction along the X axis, a +X axis direction is a direction from a back of the sheet to a front of the sheet of FIG. 1 and a −X axis direction is an opposite direction with respect to the +X axis direction. The Y axis among the XYZ axes of FIG. 1 is an axis perpendicular to the X axis and the Z axis. Among a Y axis direction along the Y axis, a +Y axis direction is a direction from a right of the sheet to a left of the sheet of FIG. 1 and a −Y axis direction is an opposite direction with respect to the +Y axis direction. The Z axis among the XYZ axes of FIG. 1 is an axis perpendicular to the X axis and the Y axis. Among the Z axis direction (axial direction) along the Z axis, a +Z axis direction is a direction from the rear end side to the leading end side of the spark plug 10 and a −Z axis direction is an opposite direction with respect to the +Z axis direction.

The center electrode 100 of the spark plug 10 is an electrode having electrical conductivity. The center electrode 100 has a rod shape extending about the axial line CA1. In the embodiment, a material of the center electrode 100 is formed of nickel alloy of which a main component is nickel (Ni) (for example, INCONEL 600 ("INCONEL" is a registered trade mark)). An external surface of the center electrode 100 is electrically insulated from outside by the insulator 200. The leading end of the center electrode 100 protrudes from the leading end side of the insulator 200. The rear end of the center electrode 100 is electrically connected to the rear end of the insulator 200. In the embodiment, the rear end of the center electrode 100 is electrically connected to the rear end of the insulator 200 through a seal body 160, a ceramic resistance 170, a seal body 180, and a terminal shell 190.

The ground electrode 400 of the spark plug 10 is an electrode having electrical conductivity. The ground electrode 400 has a shape that extends from the metal shell 300 in the +Z axis direction and then bends toward the axial line CA1. A rear end side of the ground electrode 400 is welded to the metal shell 300. A leading end side of the ground electrode 400 forms the gap SG between itself and the center electrode 100. In the embodiment, similar to the center electrode 100, a material of the ground electrode 400 is formed of nickel alloy of which a main component is nickel (Ni).

The insulator 200 of the spark plug 10 is an insulator having electrical insulation property. The insulator 200 has a tubular shape extending along the axial line CA1. In the embodiment, the insulator 200 is manufactured by firing an insulation ceramic material (for example, alumina).

The insulator 200 has an axial hole 290 that is a through hole extending about the axial line CA1. The center electrode 100 is held on the axial line CA1 in the axial hole 290 of the insulator 200 in a state of protruding from the leading end side of the insulator 200. A first tubular portion 210, a second tubular portion 220, a third tubular portion 250, and a fourth tubular portion 270 are formed on the outside of the insulator 200 in this order from the leading end side to the rear end side.

The first tubular portion 210 of the insulator 200 is a cylindrical portion tapered toward the leading end side and a leading end of the first tubular portion 210 protrudes from the leading end side of the metal shell 300. The second tubular portion 220 of the insulator 200 is a cylindrical portion having a diameter greater than that of the first tubular portion 210. The third tubular portion 250 of the insulator 200 is a cylindrical portion extending in an outer peripheral direction further than the second tubular portion 220 and the fourth tubular portion 270. The fourth tubular portion 270 of the insulator 200 is a cylindrical portion form to a rear side of the third tubular portion 250 and a rear end of the fourth tubular portion 270 protrudes from the rear end of the metal shell 300.

The metal shell 300 of the spark plug 10 is a metallic body having electrical conductivity. The metal shell 300 has a tubular shape extending about the axial line CA1. In the embodiment, a material of the metal shell 300 is carbon steel and nickel-plating is applied to a surface of the metal shell 300. In another embodiment, zinc-plating may be applied to the surface of the metal shell 300 or plating may not be applied to the surface of the metal shell 300.

The metal shell 300 is fixed to an outer surface of the insulator 200 by crimping in a state of being insulated from the center electrode 100. An end surface 310, a screw portion 320, a body portion 340, a groove portion 350, a tool engagement portion 360, and a crimping cover 380 are formed on the outside of the metal shell 300 in this order from the leading end side to the rear end side.

The end surface 310 of the metal shell 300 is a surface configuring the leading end of the metal shell 300. In the embodiment, the end surface 310 is a plane along the X axis and the Y axis, and is a plane facing the +Z axis direction. In the embodiment, the end surface 310 is a hollow disk-shaped plane. The ground electrode 400 is welded to the end surface 310. The insulator 200 protrudes in the +Z axis direction together with the center electrode 100 from a center of the end surface 310. In another embodiment, the end surface 310 may be a surface inclined to the inside of the metal shell 300 or may be a surface inclined to the outside the metal shell 300. In another embodiment, the end surface 310 may be a curved surface or a plurality of surfaces configuring steps.

The screw portion 320 of the metal shell 300 is a cylindrical portion where screw threads are formed on an outer surface thereof. In the embodiment, the spark plug 10 is configured to be mountable on the internal combustion engine 90 by engaging the screw portion 320 of the metal shell 300 with a screw hole 930 of the internal combustion engine 90. In the embodiment, a nominal diameter of the screw portion 320 is M10. In another embodiment, the nominal diameter of the screw portion 320 may be smaller than M10 (for example, M8) or may be greater than M10 (for example, M12, M14).

The body portion 340 of the metal shell 300 is a flange-shaped portion extending in an outer peripheral direction further than the groove portion 350. If the spark plug 10 is mounted on the internal combustion engine 90, a gasket 500 is compressed between the body portion 340 and the internal combustion engine 90.

The groove portion 350 of the metal shell 300 is a cylindrical portion expanding in the outer peripheral direction when the metal shell 300 is fixed to the insulator 200 by crimping. The groove portion 350 is positioned between the body portion 340 and the tool engagement portion 360.

The tool engagement portion 360 of the metal shell 300 is a flange-shaped portion extending in a polygonal shape in the outer peripheral direction further than the groove portion 350. The tool engagement portion 360 has a shape capable of engaging with a tool (not illustrated) for mounting the spark plug 10 on the internal combustion engine 90. In the embodiment, an external shape of the tool engagement portion 360 is a hexagonal shape.

The crimping cover 380 of the metal shell 300 is a portion in which the rear end side of the metal shell 300 is bent toward the insulator 200. The crimping cover 380 is formed when the metal shell 300 is fixed to the insulator 200 by crimping.

A ring member 610 and a ring member 620 are respectively disposed at the rear end side and the leading end side between the insulator 200 and the inside of the tool engagement portion 360 and the crimping cover 380 of the metal shell 300. A portion between the ring member 610 and the ring member 620 is filled with powder 650 having electrical insulation property.

The insulator 200 is held on the inside of the metal shell 300 in a state of protruding from the leading end side of the metal shell 300. An inner peripheral surface 392, a shelf portion 394, and an inner peripheral surface 396 are formed on the inside of the metal shell 300 in this order from the leading end side to the rear end side.

The inner peripheral surface 392 of the metal shell 300 is a portion positioned on the leading end side further than the shelf portion 394 on the inside of the metal shell 300. The shelf portion 394 of the metal shell 300 is an annular portion erected towards the inside further than the inner peripheral surface 392 and the inner peripheral surface 396. The inner peripheral surface 396 of the metal shell 300 is a portion positioned on the rear end side further than the shelf portion 394 on the inside of the metal shell 300.

Figure 2:
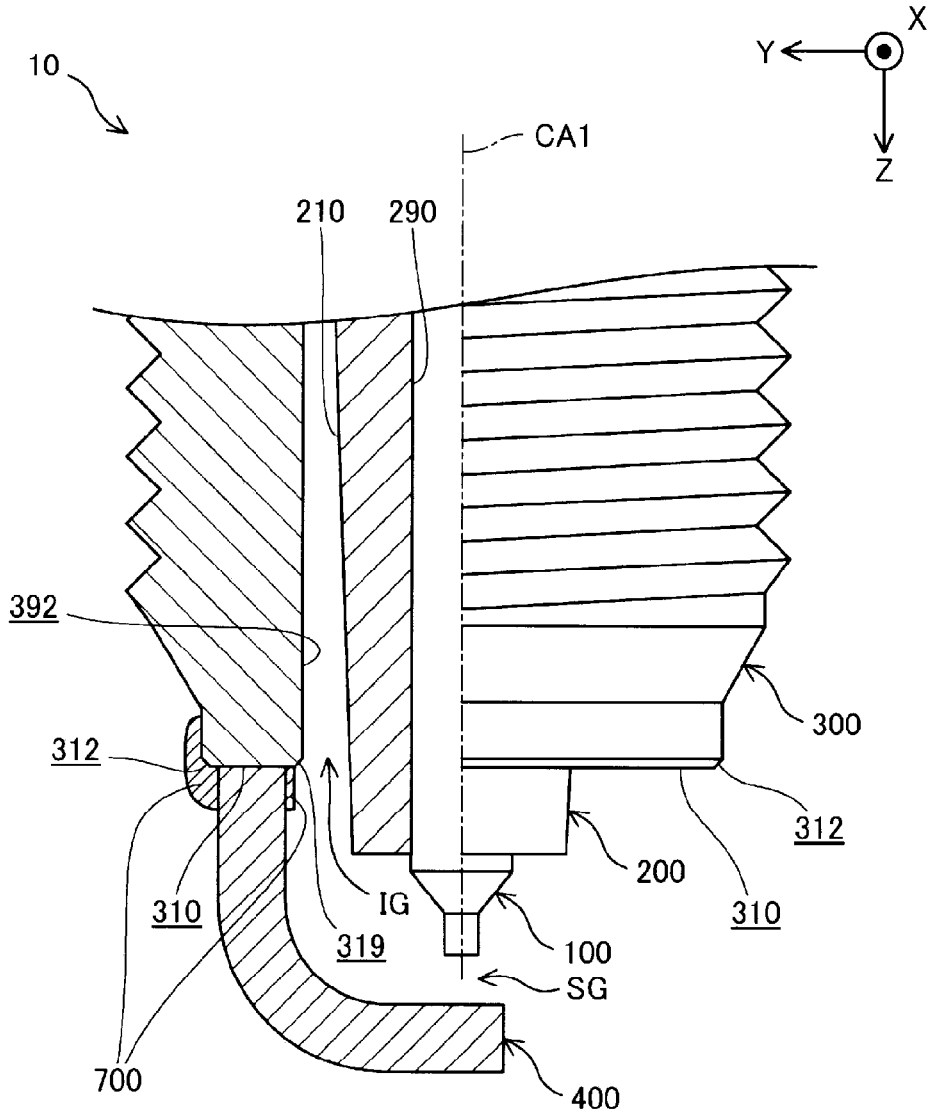
FIG. 2 is an enlarged explanatory view illustrating a leading end side of the spark plug.
Figure 3:
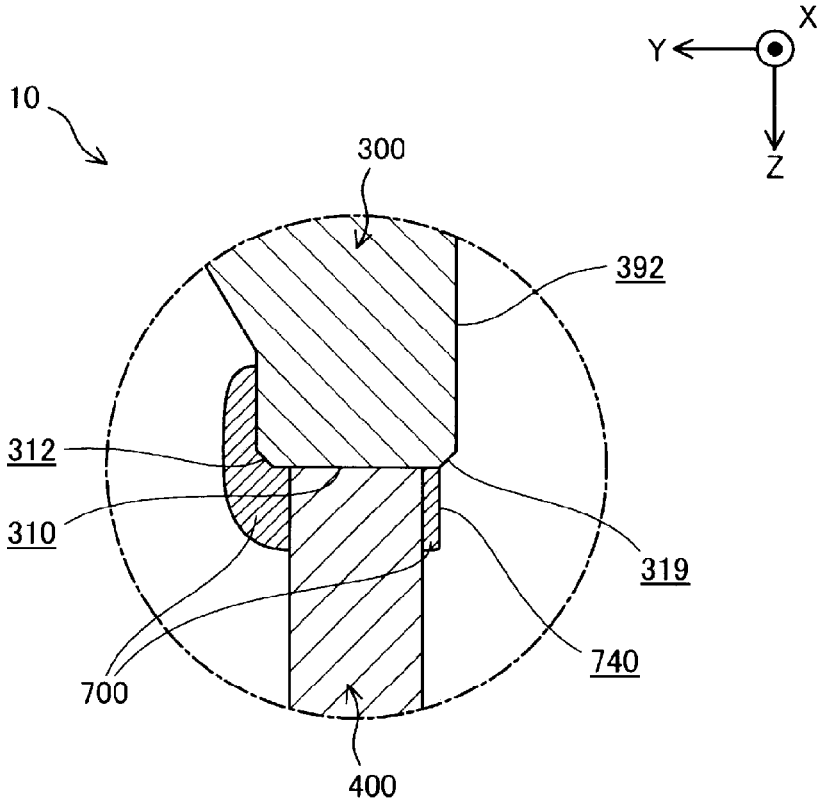
FIG. 3 is a further enlarged explanatory view illustrating a cross section of a portion in which a ground electrode is welded to a metal shell.

FIG. 2 is an enlarged explanatory view illustrating the leading end side of the spark plug 10. FIG. 3 is a further enlarged explanatory view illustrating a cross section of a portion in which the ground electrode 400 is welded to the metal shell 300.

In the embodiment, a chamfered portion 312 is formed on an outer peripheral side of the end surface 310. In the embodiment, the chamfered portion 312 is an angular surface. In another embodiment, the chamfered portion 312 may be a round surface. In another embodiment, the chamfered portion 312 may not be formed.

In the embodiment, a chamfered portion 319 is formed on an inner peripheral side of the end surface 310. In the embodiment, the chamfered portion 319 is an angular surface. In another embodiment, the chamfered portion 319 may be a round surface. In another embodiment, the chamfered portion 319 may not be formed.

A gap IG is formed between the inner peripheral surface 392 of the metal shell 300 and the first tubular portion 210 of the insulator 200. The gap IG prevents generation of the spark leak (lateral spark) causing generation of the spark discharge on the inner peripheral surface 392.

Welding sag 700, which is formed when welding the ground electrode 400 to the end surface 310, exists on the periphery of the ground electrode 400 that is welded to the end surface 310 of the metal shell 300. Among the welding sag 700 formed when welding the ground electrode 400, at least a portion which is positioned on the inside of the metal shell 300 in a radial direction is removed. In the embodiment, the welding sag 700 does not remain on the inner peripheral surface 392 of the metal shell 300. In another embodiment, the welding sag 700 may not be completely removed from the inner peripheral surface 392 and may remain on the inner peripheral surface 392. In the embodiment, the welding sag 700 does not remain on the inner peripheral surface 392 and the chamfered portion 319. In another embodiment, the welding sag 700 may not be completely removed from the chamfered portion 319 and may remain on the chamfered portion 319.

The welding sag 700 has a cross section 740 exposed to the inside of the metal shell 300 in the radial direction. The cross section 740 is formed when removing the welding sag 700 from the inner peripheral surface 392 after the ground electrode 400 is welded to the end surface 310. In the embodiment, the cross section 740 is a surface along the Z axis. The cross section 740 is a cross section connected to the surface of the metal shell 300, and in the embodiment, is connected to the chamfered portion 319. In another embodiment, if the chamfered portion 319 is not formed, the cross section 740 may be a cross section connected to the inner peripheral surface 392.

A2. Manufacturing Method of Spark Plug

Figure 4:
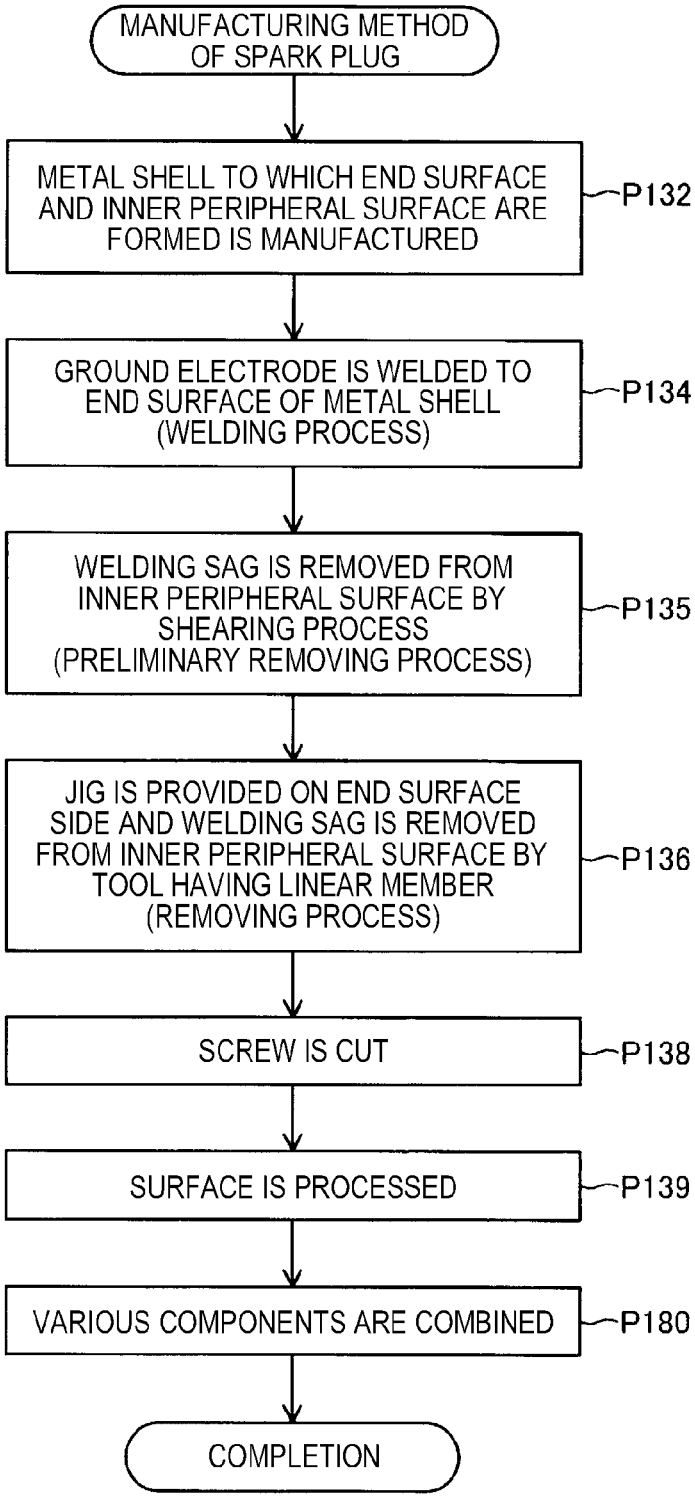
FIG. 4 is a process chart illustrating a manufacturing method of the spark plug.

FIG. 4 is a process chart illustrating a manufacturing method of the spark plug 10. When manufacturing the spark plug 10A, the manufacturer of the spark plug 10 manufactures a metal shell 300P which is to be manufactured into the metal shell 300 (process P132). In the embodiment, the manufacturer manufactures the metal shell 300P by a pressing process and a cutting process. The metal shell 300P has a tubular shape to which at least the end surface 310 and the inner peripheral surface 392 are formed. In the embodiment, the screw portion 320 is not formed to the metal shell 300P. In the embodiment, the chamfered portion 312 and the chamfered portion 319 are formed to the metal shell 300P.

After the metal shell 300P is manufactured (process P132), the manufacturer performs a welding process (process P134). The welding process (process P134) is a process of welding a ground electrode 400P, which is to be manufactured into the ground electrode 400, to the end surface 310 of the metal shell 300P. In the embodiment, in the welding process (process P134), the ground electrode 400P has a shape that is extended straight without being bent.

Figure 5:
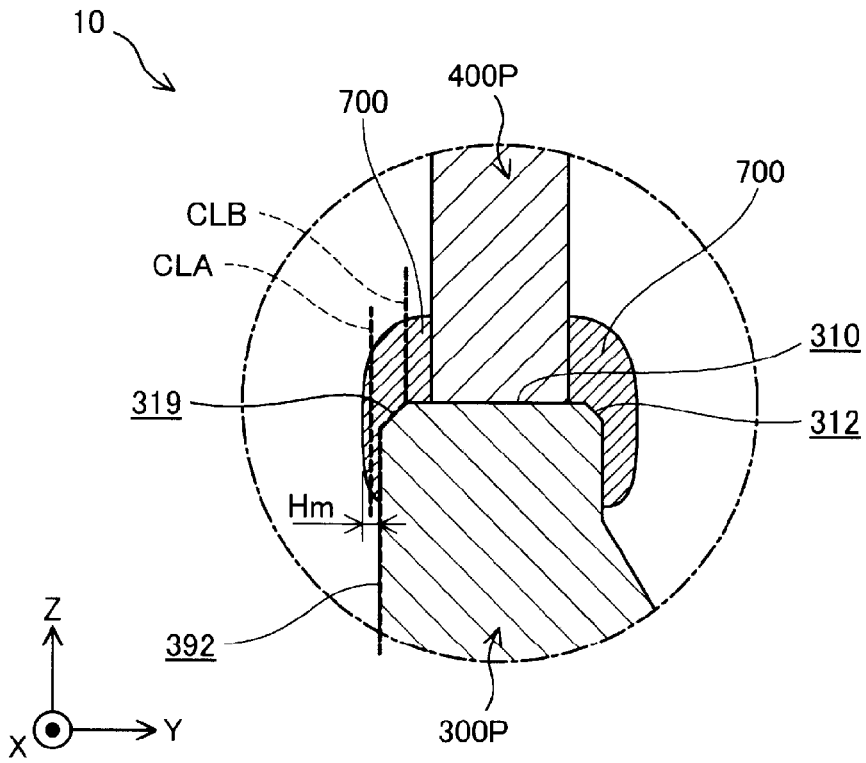
FIG. 5 is an explanatory view illustrating a cross section of a portion of the metal shell to which the ground electrode is welded.

FIG. 5 is an explanatory view illustrating a cross section of a portion of the metal shell 300P to which the ground electrode 400P is welded. The cross section of the portion of FIG. 5 illustrates a portion corresponding to the cross section of the portion of FIG. 3. In the embodiment, in the welding process (process P134), the manufacturer bonds the end surface 310 to the ground electrode 400P by resistance welding while pressing the ground electrode 400P against the end surface 310, in a state where the metal shell 300P is fixed such that the end surface 310 is directed upward in the vertical direction. The welding sag 700 is formed in the periphery of the ground electrode 400 on the end surface 310 by the welding process (process P134). In the welding process (process P134), the welding sag 700 is formed from the end surface 310 to the inner peripheral surface 392.

Returning to the description of FIG. 4, after the welding process (process P134) is performed, the manufacturer performs a preliminary removing process (process P135). The preliminary removing process (process P135) is a process of removing the welding sag 700 from the inside of the metal shell 300P by a shearing process (punching process). In the embodiment, in the preliminary removing process (process P135), the manufacturer removes the welding sag 700 from the inside of the metal shell 300P along a chain line CLA (see FIG. 5) positioned on the inside further than the inner peripheral surface 392. In another embodiment, in the preliminary removing process (process P135), the manufacturer may remove the welding sag 700 from the inside of the metal shell 300P by a cutting process (for example, a milling process, a drilling process, and the like) in addition to the shearing process or instead of the shearing process.

After the preliminary removing process (process P135) is performed, the manufacturer performs a removing process (process P136). The removing process (process P136) is a process of removing the welding sag 700 from the inside of the metal shell 300P by grinding.

In the embodiment, in the removing process (process P136), the manufacturer removes the welding sag 700 from the inside of the metal shell 300P along a chain line CLB (see FIG. 5) closer to the inner peripheral surface 392 than the chain line CLA. In the embodiment, the chain line CLB has a shape along the chamfered portion 319 and the inner peripheral surface 392.

A height Hm of FIG. 5 is a height of the welding sag 700 along a direction from the inner peripheral surface 392 of the metal shell 300P toward the inside of the metal shell 300P and perpendicular to the inner peripheral surface 392. In other words, the height Hm is a protrusion amount of the welding sag 700 protruding to the inside of the metal shell 300P. In the embodiment, in the removing process (process P136), the manufacturer removes the welding sag 700 until the height Hm becomes 0.05 mm or less.

Figure 6:
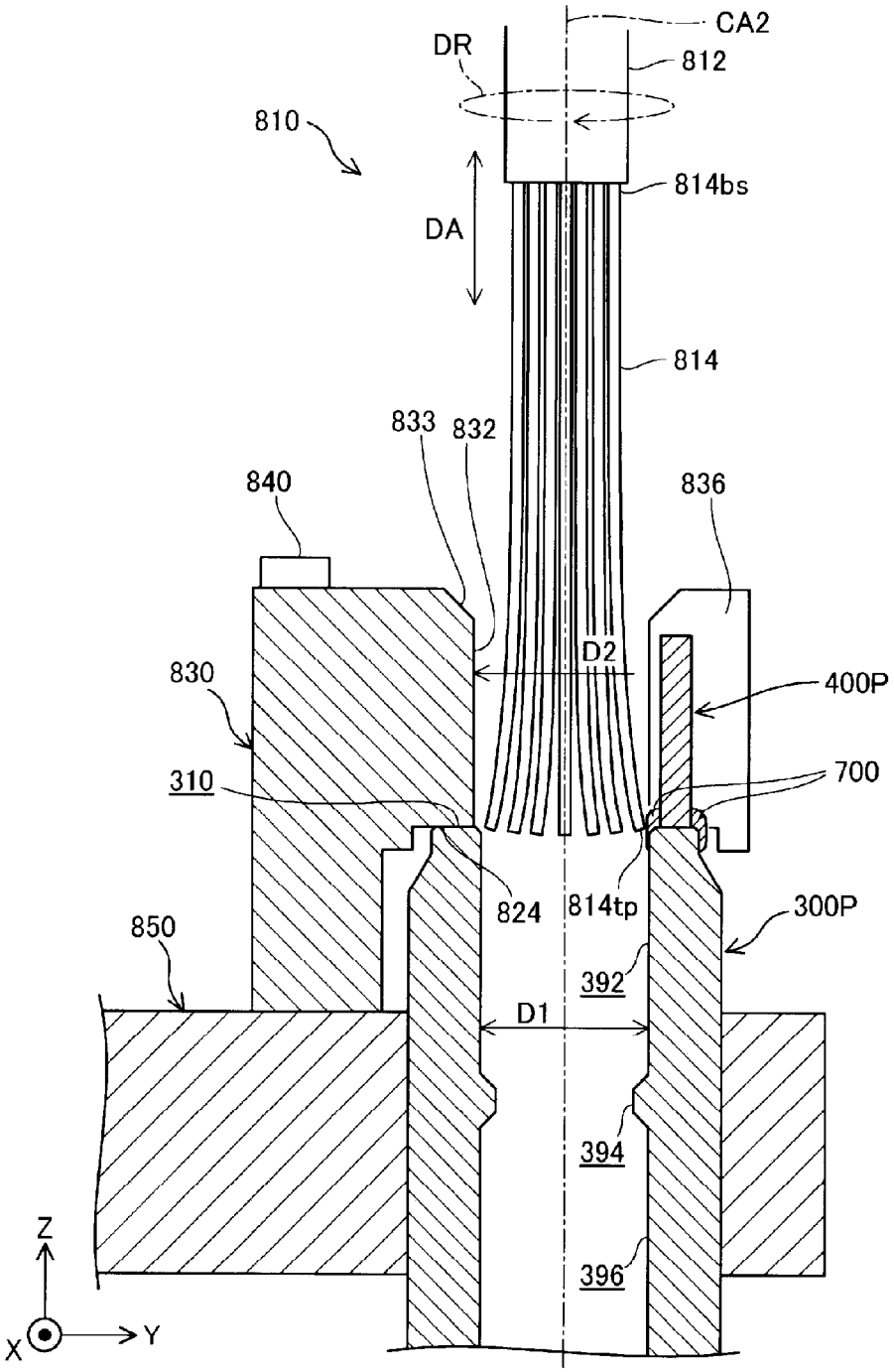
FIG. 6 is an explanatory view illustrating a state of performing a removing process.

FIG. 6 is an explanatory view illustrating a state of performing the removing process (process P136). In the removing process (process P136), the manufacturer removes the welding sag 700 from the inside of the metal shell 300P by using a tool 810 having a linear member 814.

Figure 7:
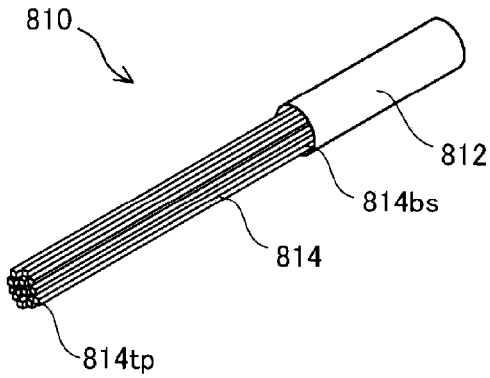
FIG. 7 is an explanatory view illustrating a configuration of a tool.

FIG. 7 is an explanatory view illustrating a configuration of the tool 810. The tool 810 includes a cylindrical portion 812 and the linear member 814. The cylindrical portion 812 of the tool 810 is a member having a cylindrical shape made of a metal and holds the linear member 814. The linear member 814 of the tool 810 is a member formed by linearly bonding ceramic fibers together. In the embodiment, a material of the ceramic fiber of the linear member 814 contains alumina ($Al_2O_3$) and silica ($SiO_2$) as main components. A bonding material (binder) for bonding ceramic fibers together may be an inorganic material or may be an organic material. The tool 810 may include one or more linear members 814, and in the embodiment, includes a plurality of linear members 814. A base end portion 814*bs* that is one end portion of the linear member 814 is a fixed end fixed to the cylindrical portion 812. A tip end portion 814*tp* that is the other end portion of the linear member 814 is a free end that is not fixed.

Returning to the description of FIG. 6, in the removing process (process P136), the manufacturer reciprocates the tool 810 in an axial direction DA along an axial line CA2 while rotating the tool 810 in a rotation direction DR around the axial line CA2 of the metal shell 300P fixed to a jig 850. Thus, the tip end portion 814*tp* of the linear member 814 comes into contact with the welding sag 700 formed on the inside of the metal shell 300P while being bent to the outside by a centrifugal force due to the rotation. As a result, the welding sag 700 is grinded by the tip end portion 814*tp* of the linear member 814.

In the embodiment, the manufacturer provides a jig 830 having a through hole 832 at the end surface 310 side of the metal shell 300P when fixing the metal shell 300P to the jig 850. In a state where the jig 830 is provided to the metal shell 300P, an axis of the through hole 832 in the jig 830 is positioned on the axial line CA2 of the metal shell 300P. In the embodiment, the jig 830 comes into contact with the end surface 310 of the metal shell 300P. In another embodiment, the jig 830 may be separated from the end surface 310 of the metal shell 300P.

An inner diameter D1 of the inner peripheral surface 392 of the metal shell 300P is smaller than an inner diameter D2 of the through hole 832 of the jig 830. In other words, a relationship between the inner diameter D1 of the metal shell 300P and the inner diameter D2 of the jig 830 satisfies $D1<D2$. It is preferable that the relationship between the inner diameter D1 and the inner diameter D2 satisfies $D1+0.1\ mm \leq D2 \leq D1+0.3\ mm$ from the viewpoint of sufficient removal of the welding sag 700 and prevention of damage to the tool 810. An evaluation of the inner diameters D1 and D2 will be described later.

Figure 8:
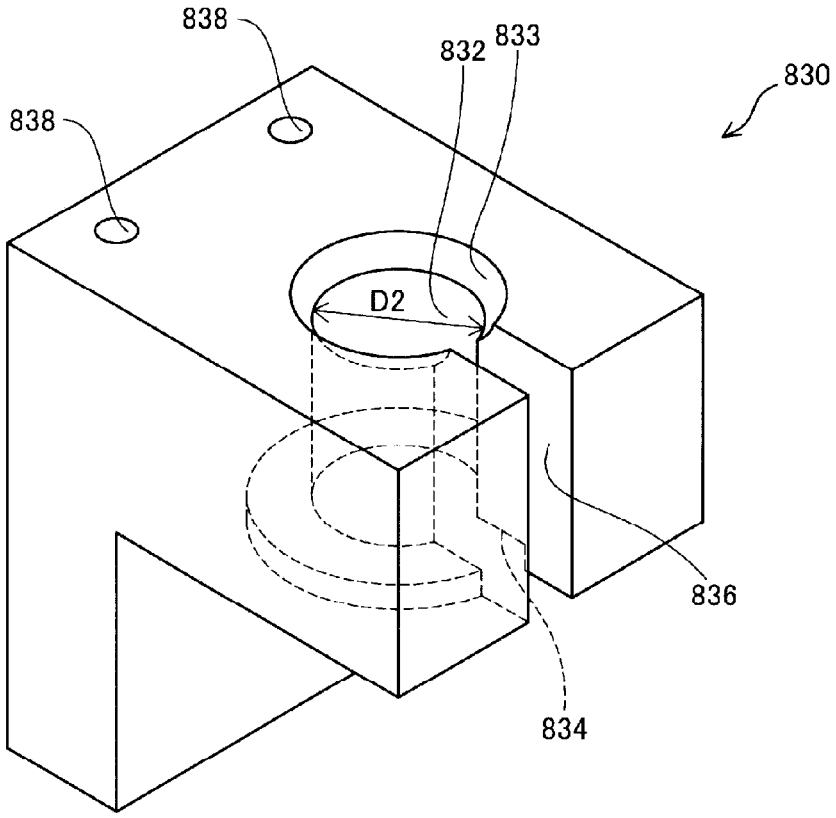
FIG. 8 is an explanatory view illustrating a detailed configuration of a jig.

FIG. 8 is an explanatory view illustrating a detailed configuration of the jig 830. The jig 830 has a chamfered portion 833 and a depression portion 834, a cutout portion 836, and a through hole 838 in addition to the through hole 832. The chamfered portion 833 of the jig 830 is an angular surface that is positioned opposite to the end surface 310 in a state where the jig 830 is provided to the metal shell 300P and is formed by chamfering one end portion of two end portions of the through hole 832. The depression portion 834 of the jig 830 is a portion that is formed by depressing a periphery of the other end portion positioned opposite to the chamfered portion 833 of the two end portions of the through hole 832 and forms a space into which the end surface 310 of the metal shell 300P enters. The cutout portion 836 of the jig 830 is a portion that is cut out along the through hole 832 and forms a space in which the ground electrode 400P and the welding sag 700 enter. A bolt 840 for fixing the jig 830 to the jig 850 enters the through hole 838 of the jig 830.

Returning to the description of FIG. 4, after the removing process (process P136) is performed, the manufacturer forms the screw portion 320 to the metal shell 300P by performing a cutting process of the screw (process P138). Thereafter, the manufacturer performs surfacing process (plating process) on the metal shell 300P (process P139). Thereby, the metal shell 300 is completed.

After the metal shell 300 is completed (process P139), the manufacturer combines other members (the center electrode 100, the insulator 200, and the like) to the metal shell 300 (process P180). Thereby, the spark plug 10 is completed. In the embodiment, the manufacturer performs bending process to the ground electrode 400P when combining other members to the metal shell 300.

A3. Evaluation of Spark Plug

Figure 9:
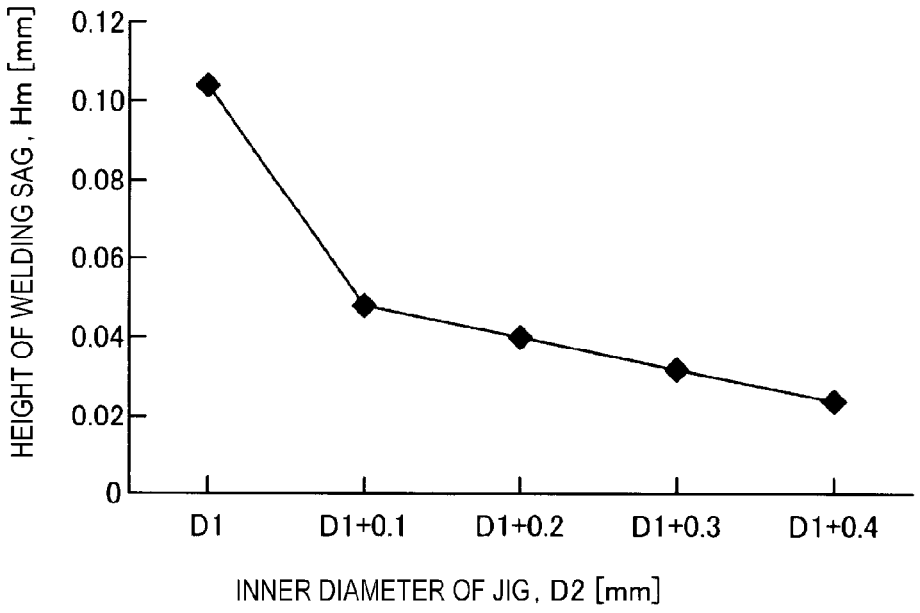
FIG. 9 is a graph illustrating a result of a test in which an inner diameter of the metal shell and an inner diameter of the jig are evaluated.

FIG. 9 is a graph illustrating a result of a test in which the inner diameter D1 of the metal shell 300P and the inner diameter D2 of the jig 830 are evaluated. In the graph of FIG. 9, the evaluations of the inner diameters D1 and D2 are illustrated by taking the inner diameter D2 in a horizontal axis based on the inner diameter D1 and taking the height Hm of the welding sag 700 in a vertical axis.

In the evaluation test of FIG. 9, a tester prepared a plurality of jigs having inner diameters D2 different from the inner diameter D1 of the metal shell 300P and performed the removing process (process P136) using each jig. After performing the removing process (process P136), the tester measured the height Hm of the welding sag 700 on the metal shell 300P.

According to a result of the evaluation test of FIG. 9, it is discovered that, the greater the inner diameter D2 is as compared to the inner diameter D1, the height Hm of the welding sag 700 is lower and thus the welding sag 700 can be more effectively removed from the inner peripheral surface 392. However, when the inner diameter D2 is greater than the inner diameter D1 by 0.4 mm or more, the linear member 814 of the tool 810 is damaged. The reason thereof is considered that the linear member 814 is more likely to be pressed by the end surface 310 as the inner diameter D2 is greater than the inner diameter D1. Thus, it is preferable that the relationship between the inner diameter D1 and the inner diameter D2 satisfies D1+0.1 mm≤D2≤D1+0.3 mm from the viewpoint of sufficient removal of the welding sag 700 and prevention of damage to the tool 810.

A4. Advantages

According to the embodiment described above, in the removing process (process P136), since the welding sag 700 is grinded by the tip end portion 814*tp* of the linear member 814 bent to the outside by the centrifugal force due to the rotation, it is possible to effectively remove the welding sag 700 protruding to the inside of the metal shell 300P. Furthermore, since the welding sag 700 is grinded by the plurality of linear members 814, it is possible to more effectively remove the welding sag 700 protruding to the inside of the metal shell 300P.

Furthermore, the tip end portion 814*tp* of the linear member 814 is caused to come into contact with the welding sag 700 by moving the tool 810 in the axial direction DA while rotating the tool 810 inside the through hole 832 of the jig 830. Thus, it is possible to smoothly move the tool 810 in the axial direction DA. Thus, it is possible to improve workability during the removing process (process P136).

Furthermore, the relationship between the inner diameter D1 of the metal shell 300P in the inner peripheral surface 392 and the inner diameter D2 of the jig 830 in the through hole 832 satisfies D1<D2. Thus, it is possible to sufficiently remove the welding sag 700 protruding to the inside of the metal shell 300P.

Furthermore, the relationship between the inner diameter D1 and the inner diameter D2 satisfies D1+0.1 mm≤D2≤D1+0.3 mm Thus, it is possible to prevent the damage to the tool 810 while sufficiently removing the welding sag 700 protruding to the inside of the metal shell 300P.

A5. First Modification Example

Figure 10:
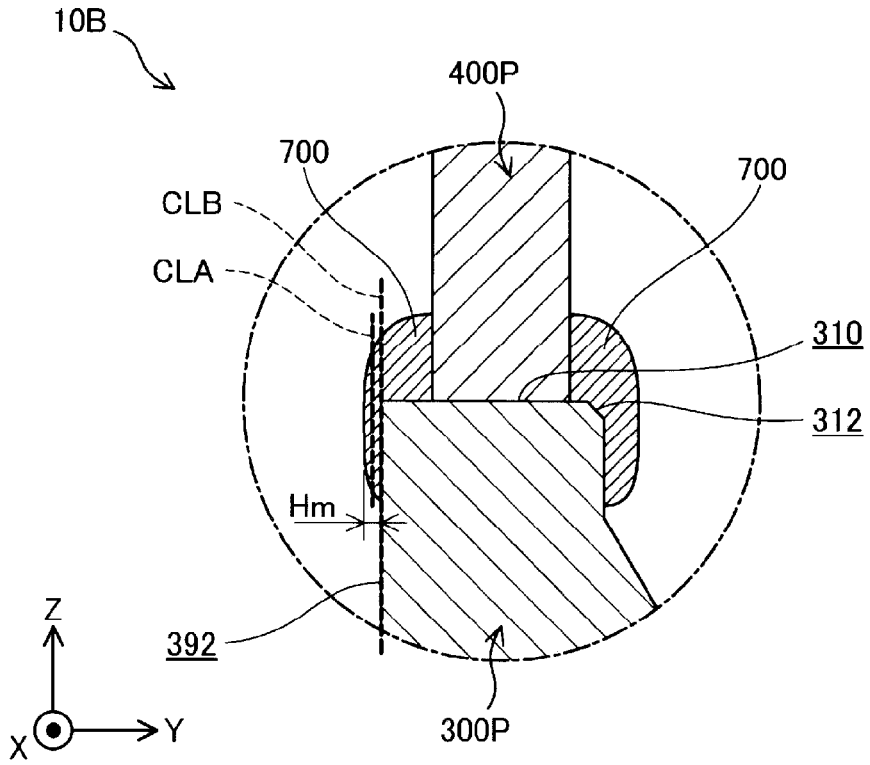
FIG. 10 is an explanatory view illustrating a cross section of a portion of a metal shell to which a ground electrode is welded in a first modification example.

FIG. 10 is an explanatory view illustrating a cross section of a portion of the metal shell 300P to which the ground electrode 400P is welded in a first modification example. The first modification example is similar to the embodiment described above other than that, in the removing process (process P136), the welding sag 700 is removed along a chain line CLB parallel to the inner peripheral surface 392. According to the first modification example, similar to the embodiment described above, it is possible to effectively remove the welding sag 700 protruding to the inside of the metal shell 300P.

A6. Second Modification Example

Figure 11:
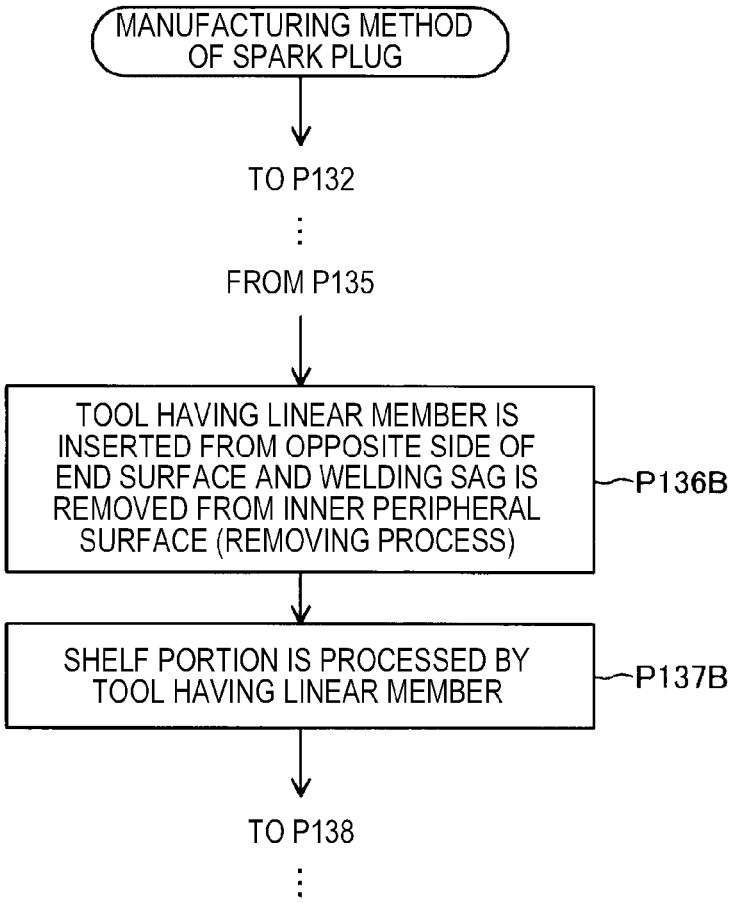
FIG. 11 is a process chart illustrating a manufacturing method of a spark plug in a second modification example.

FIG. 11 is a process chart illustrating a manufacturing method of a spark plug 10 in a second modification example. The second modification example is similar to the embodiment described above other than that a removing process (process P136B) is provided in which a using method of the tool 810 is different from that of the removing process (process P136) described above and a process (process P137B) for processing the shelf portion 394 of the metal shell 300P using the tool 810 is provided.

In the removing process (process P136B), the manufacturer inserts the linear member 814 of the tool 810 into the inner peripheral surface 392 from an opposite side of the end surface 310 of the metal shell 300P. Thereafter, the manufacturer causes the tip end portion 814*tp* of the linear member 814 to come into contact with the welding sag 700 while rotating the tool 810, in a state where the linear member 814 is inserted into the inner peripheral surface 392. As a result, the welding sag 700 is grinded by the tip end portion 814*tp* of the linear member 814.

After the removing process (process P136B) is performed, the manufacturer moves the tip end portion 814*tp* of the linear member 814 from the inner peripheral surface 392 to the opposite side of the end surface 310 while rotating the tool 810. Thus, the tip end portion 814*tp* of the linear member 814 comes into contact with the shelf portion 394. As a result, the shelf portion 394 is grinded by the tip end portion 814*tp* of the linear member 814. As described above, after a shape of the shelf portion 394 is finished, similar to the embodiment described above, the manufacturer performs a process of forming the screw portion 320 (process P138) and thereafter.

According to the second modification example described above, similar to the embodiment described above, it is possible to effectively remove the welding sag 700 protruding to the inside of the metal shell 300P. Furthermore, it is possible to smoothly move the tool 810 in the axial direction DA without providing the jig 830 to the end surface 310 side of the metal shell 300P. Thus, it is possible to improve workability of the removing process (process P136B). Furthermore, after the welding sag 700 is removed (process P136B), it is possible to process the shelf portion 394 of the metal shell 300P together with the work for taking out the tool 810 from the metal shell 300P.

B. Other Embodiments

The invention is not limited to the embodiment, the examples, and the modification examples described above, and can be realized by various configurations without departing from the scope of the invention. For example, technical characteristics in the embodiment, the examples, and the modification examples corresponding to technical characteristics in each aspect described in the summary of the invention can be appropriately substituted or combined to solve a part or all of the problems described above or to obtain a part or all of the advantages described above. Furthermore, the technical characteristics can be appropriately removed if the technical characteristics are not described as essential technical characteristics in this specification.

For example, at least a part of the inner peripheral surface 392 and the chamfered portion 319 of the metal shell may be a portion that is configured by the welding sag 700. Furthermore, after the welding process (process P134) is performed, the welding sag 700 may be removed from the inner peripheral surface 392 by performing the removing process (process P136) without performing the preliminary removing process (process P135).

The invention provides illustrative, non-limiting aspects as follows:

(1) According to an aspect, there is provided a manufacturing method of a spark plug for manufacturing the spark plug including a rod-shaped center electrode extending in an axial direction, an insulator having a tubular shape having an axial hole and holding the center electrode in the axial hole, a metal shell having a tubular shape having an end surface and an inner peripheral surface, a gap being formed between a leading end side of the insulator and the inner peripheral surface, and a ground electrode welded to the end surface, the manufacturing method including: welding the ground electrode to the end surface; and removing welding sag, which is formed inside the metal shell by the welding, by causing a tip end portion of a linear member to come into contact with the welding sag while rotating a tool in which a base end portion of the linear member is fixed.

Accordingly, since the welding sag is grinded by the tip end portion of the linear member bent to the outside by a centrifugal force due to the rotation, it is possible to effectively remove the welding sag protruding to the inside of the metal shell.

(2) In the above manufacturing method of the spark plug, the linear member may be formed by linearly bonding ceramic fibers together, the tool may be a tool in which base end portions of a plurality of the linear members are fixed, and the welding sag may be removed by causing the tip end portions of the plurality of linear members to come into contact with the welding sag while rotating the tool.

Accordingly, since the welding sag is grinded by the plurality of linear members, it is possible to further effectively remove the welding sag protruding to the inside of the metal shell.

(3) In the above manufacturing method of the spark plug, the removing may include providing a jig having a through hole at the end surface side of the metal shell, and causing the tip end portion of the linear member to contact with the welding sag by moving the tool in the axial direction while rotating the tool inside the through hole.

Accordingly, it is possible to smoothly move the tool in the axial direction. Thus, it is possible to improve workability during the removing of the welding sag.

(4) In the above manufacturing method of the spark plug, a relationship between an inner diameter D1 of the inner peripheral surface of the metal shell and an inner diameter D2 of the through hole of the jig may satisfy D1<D2.

Accordingly, it is possible to sufficiently remove the welding sag protruding to the inside of the metal shell.

(5) In the above manufacturing method of the spark plug, the relationship between the inner diameter D1 and the inner diameter D2 may satisfy D1+0.1 mm≤D2≤D1+0.3 mm.

Accordingly, it is possible to prevent damage to the tool while sufficiently removing the welding sag protruding to the inside of the metal shell.

(6) In the above manufacturing method of the spark plug, the removing may include inserting the linear member into the inner peripheral surface from an opposite side of the end surface of the metal shell, and causing the tip end portion of the linear member to contact with the welding sag while rotating the tool, in a state where the linear member is inserted into the inner peripheral surface from the opposite side.

Accordingly, it is possible to smoothly move the tool in the axial direction without providing the jig on the end surface side of the metal shell. Thus, it is possible to improve workability during the removing of the welding sag.

(7) In the above manufacturing method of the spark plug, the metal shell may have a shelf portion that is positioned on the opposite side further than the inner peripheral surface, the inner diameter of the shelf portion of the metal shell may be smaller than the inner diameter of the inner peripheral surface of the metal shell, and the removing may further include causing the tip end portion of the linear member to contact with the shelf portion by moving the tip end portion from the inner peripheral surface to the opposite side while rotating the tool, after the welding sag is removed.

Accordingly, it is possible to process the shelf portion of the metal shell together with taking out work of the tool from the metal shell after the welding sag is removed.

(8) In the above manufacturing method of the spark plug, the welding sag may be removed until a height of the welding sag becomes 0.05 mm or less along a direction from the inner peripheral surface toward the inside of the metal shell and perpendicular to the inner peripheral surface.

Accordingly, it is possible to manufacture the spark plug that is capable of sufficiently suppressing generation of the spark leak caused by the welding sag.

(9) The above manufacturing method of the spark plug may further include forming a male screw having a nominal diameter of M10 or less on an outer periphery of the metal shell.

Accordingly, it is possible to effectively remove the welding sag protruding to the inside of the metal shell in the spark plug having a nominal diameter of M10 or less.

(10) In the above manufacturing method of the spark plug, the tip end portion of the linear member may be a free end that is not fixed.

The invention can be realized by various forms other than the spark plug and the manufacturing method of the spark plug. For example, the invention can be realized in a form of a metal shell to which a ground electrode is welded, an internal combustion engine including a spark plug, and a manufacturing apparatus of a spark plug.

DESCRIPTION OF REFERENCE NUMERALS AND SIGNS

10 SPARK PLUG
90 INTERNAL COMBUSTION ENGINE
100 CENTER ELECTRODE
160 SEAL BODY
170 CERAMIC RESISTANCE
180 SEAL BODY
190 TERMINAL SHELL
200 INSULATOR
210 FIRST TUBULAR PORTION
220 SECOND TUBULAR PORTION
250 THIRD TUBULAR PORTION
270 FOURTH TUBULAR PORTION
290 AXIAL HOLE
300, 300P METAL SHELL
310 END SURFACE
312, 319 CHAMFERED PORTION
320 SCREW PORTION
340 BODY PORTION
350 GROOVE PORTION
360 TOOL ENGAGEMENT PORTION
380 CRIMPING COVER
392 INNER PERIPHERAL SURFACE
394 SHELF PORTION
396 INNER PERIPHERAL SURFACE
400, 400P GROUND ELECTRODE
500 GASKET
610, 620 RING MEMBER
650 POWDER
700 WELDING SAG
740 CROSS SECTION
810 TOOL
812 CYLINDRICAL PORTION
814 LINEAR MEMBER
814*bs* BASE END PORTION
814*tp* TIP END PORTION
830 JIG
832 THROUGH HOLE
833 CHAMFERED PORTION
834 DEPRESSION PORTION
836 CUTOUT PORTION

838 THROUGH HOLE
840 BOLT
850 JIG
910 INNER WALL
920 COMBUSTION CHAMBER
930 SCREW HOLE

Having described the invention, the following is claimed:

1. A manufacturing method of a spark plug for manufacturing the spark plug including a rod-shaped center electrode extending in an axial direction, an insulator having a tubular shape having an axial hole and holding the center electrode in the axial hole, a metal shell having a tubular shape having an end surface and an inner peripheral surface, a gap being formed between a leading end side of the insulator and the inner peripheral surface, and a ground electrode welded to the end surface, the manufacturing method comprising:

welding the ground electrode to the end surface; and removing welding sag, which is formed inside the metal shell by the welding, by causing a tip end portion of a linear member to come into contact with the welding sag while rotating a tool in which a base end portion of the linear member is fixed.

2. The manufacturing method of the spark plug according to claim 1, wherein the linear member is formed by linearly bonding ceramic fibers together, wherein the tool is a tool in which base end portions of a plurality of the linear members are fixed, and wherein the welding sag is removed by causing the tip end portions of the plurality of linear members to come into contact with the welding sag while rotating the tool.

3. The manufacturing method of the spark plug according to claim 1, wherein the removing includes providing a jig having a through hole at the end surface side of the metal shell, and causing the tip end portion of the linear member to contact with the welding sag by moving the tool in the axial direction while rotating the tool inside the through hole.

4. The manufacturing method of the spark plug according to claim 3, wherein a relationship between an inner diameter D1 of the inner peripheral surface of the metal shell and an inner diameter D2 of the through hole of the jig satisfies D1<D2.

5. The manufacturing method of the spark plug according to claim 4, wherein the relationship between the inner diameter D1 and the inner diameter D2 satisfies D1+0.1 mm≤D2≤D1+0.3 mm.

6. The manufacturing method of the spark plug according to claim 1, wherein the removing includes inserting the linear member into the inner peripheral surface from an opposite side of the end surface of the metal shell, and causing the tip end portion of the linear member to contact with the welding sag while rotating the tool, in a state where the linear member is inserted into the inner peripheral surface from the opposite side.

7. The manufacturing method of the spark plug according to claim 6, wherein the metal shell has a shelf portion that is positioned on the opposite side further than the inner peripheral surface, wherein the inner diameter of the shelf portion of the metal shell is smaller than the inner diameter of the inner peripheral surface of the metal shell, and wherein the removing further includes causing the tip end portion of the linear member to contact with the shelf portion by moving the tip end portion from the inner peripheral surface to the opposite side while rotating the tool, after the welding sag is removed.

8. The manufacturing method of the spark plug according to claim 1, wherein the welding sag is removed until a height of the welding sag becomes 0.05 mm or less along a direction from the inner peripheral surface toward the inside of the metal shell and perpendicular to the inner peripheral surface.

9. The manufacturing method of the spark plug according to claim 1, further comprising:

forming a male screw having a nominal diameter of M10 or less on an outer periphery of the metal shell.

10. The manufacturing method of the spark plug according to claim 1, wherein the tip end portion of the linear member is a free end that is not fixed.

* * * * *